US006135615A

United States Patent [19]

Lee

[11] Patent Number: 6,135,615

[45] Date of Patent: Oct. 24, 2000

[54] LAMP SUSPENSION TRACK ASSEMBLY

[76] Inventor: Cheng-Ping Lee, No. 1154, Chung-Ming South Rd., Taichung, Taiwan

[21] Appl. No.: 09/300,944

[22] Filed: Apr. 28, 1999

[51] Int. Cl.[7] ..... H01R 33/00

[52] U.S. Cl. ..... 362/226; 362/227; 362/250; 362/147; 362/391; 362/404

[58] Field of Search ..... 362/226, 227, 362/391, 404, 407, 408, 145, 147, 249, 250, 368, 217, 219, 220, 221, 225

[56] References Cited

U.S. PATENT DOCUMENTS

| | | | |
|---|---|---|---|
| 4,245,874 | 1/1981 | Bishop | 439/94 |
| 5,618,192 | 4/1997 | Drury | 439/110 |
| 5,833,358 | 11/1998 | Patik | 362/391 |

*Primary Examiner*—Sandra O'Shea
*Assistant Examiner*—Ismael Negron
*Attorney, Agent, or Firm*—Rosenberg, Klein & Lee

[57] ABSTRACT

A lamp suspension track assembly includes an elongated positioning guide track having two opposite sides each defining a guide groove therein, two elongated flexible guide tracks each having a first side formed with a guide rail received in the guide groove of the positioning guide track, and a second side defining a receiving channel therein, two conducting strips each received in the receiving channel, and a positioning cap attached to one end of the positioning guide track and secured to one end of each of the two flexible guide tracks. By such an arrangement, the lamp suspension track assembly can be bent around a proper angle due to the flexibility of the flexible guide tracks, thereby increasing the versatility of the lamp suspension track assembly.

11 Claims, 14 Drawing Sheets

LAMP SUSPENSION TRACK ASSEMBLY

BACKGROUND OF THE INVENTION

1. Field of the Invention

The present invention relates to a lamp suspension track assembly.

2. Description of the Related Prior Art

A first type of conventional lamp suspension track 52 is shown in FIGS. 1 and 2, and includes an elongated T-shaped plastic bar 522, and two copper beams 521 each attached to one side of the plastic bar 52. In assembly, a plurality of support bases 51 mounted on the lamp suspension track 52, and a plurality of support rods 53 each attached to a respective support base 51. When the support rod 53 is oriented upward, a positioning base 54 is attached to the support rod 53 to fix the support rod 53 to the ceiling. When the support rod 53 is oriented downward, a lamp 55 is attached to the support rod 53, thereby hanging the lamp 55 to the lamp suspension track 52. However, the lamp suspension track 52 is rigid, and cannot be arbitrarily bent, thereby limiting the versatility of the lamp suspension track 52.

A second type of conventional lamp suspension track 10 shown in FIG. 3 can be fixed to the ceiling, and includes a guide track 11. A connector 121 is slidably attached to the guide track 11 to hang a lamp 12 to the guide track 11. However, the guide track 11 is made by an aluminum extrusion treatment, and cannot be arbitrarily bent, thereby limiting the versatility of the lamp suspension track 10.

A third type of conventional lamp suspension track 20 is shown in FIGS. 4 and 5, and includes a flexible connector 22, and two guide tracks 21 each attached to the flexible connector 22. However, the flexible connector 22 can only be slightly bent around a determined angle, and cannot be bent around the angle A as shown in FIG. 5, thereby limiting the versatility of the lamp suspension track 20.

The present invention has arisen to overcome the disadvantage of the conventional lamp suspension tracks.

SUMMARY OF THE INVENTION

The primary objective of the present invention is to provide a lamp suspension track assembly including an elongated positioning guide track having two opposite sides each defining a guide groove therein, two elongated flexible guide tracks each having a first side formed with a guide rail received in the guide groove of the positioning guide track, and a second side defining a receiving channel therein, two conducting strips each received in the receiving channel, and a positioning cap attached to one end of the positioning guide track and secured to one end of each of the two flexible guide tracks.

Further objectives and advantages of the present invention will become apparent after a careful reading of the detailed description with reference to the accompanying drawings.

DETAILED DESCRIPTION OF THE PREFERRED EMBODIMENTS

Figure 1:
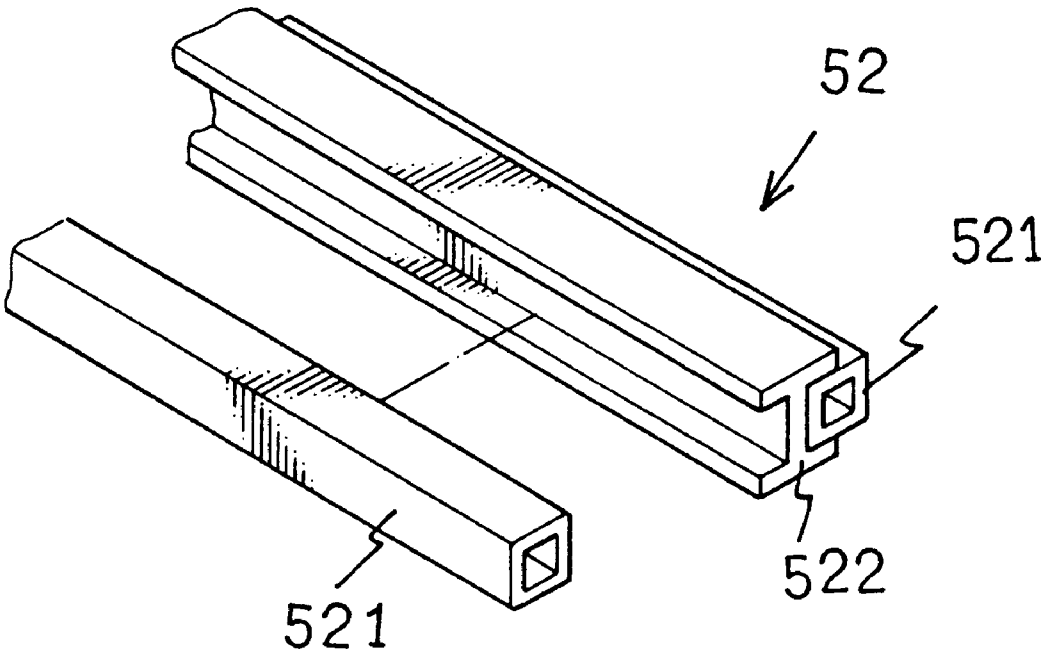
FIG. 1 PRIOR ART
FIG. 1 is an exploded view of a first conventional lamp suspension track according to the prior art.
Figure 2:
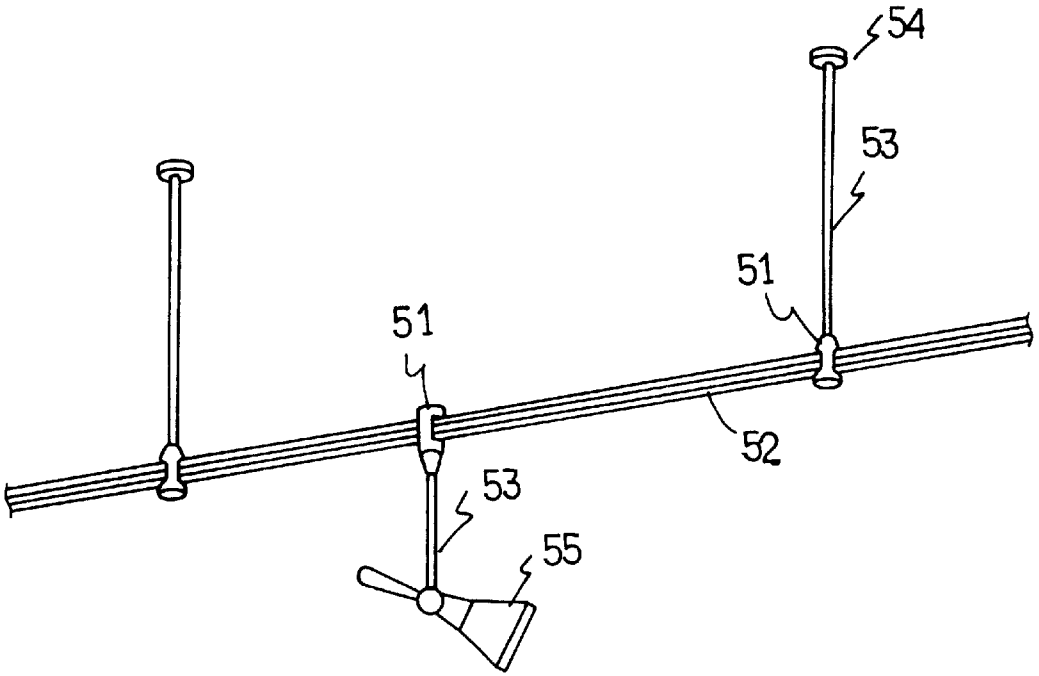
FIG. 2 PRIOR ART
FIG. 2 is an assembly view of the first conventional lamp suspension track as shown in FIG. 1.
Figure 3:
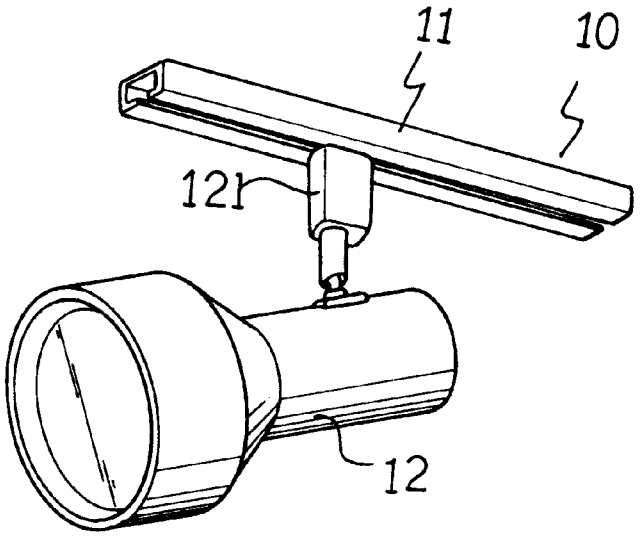
FIG. 3 PRIOR ART
FIG. 3 is a perspective view of a second conventional lamp suspension track according to the prior art.
Figure 4:
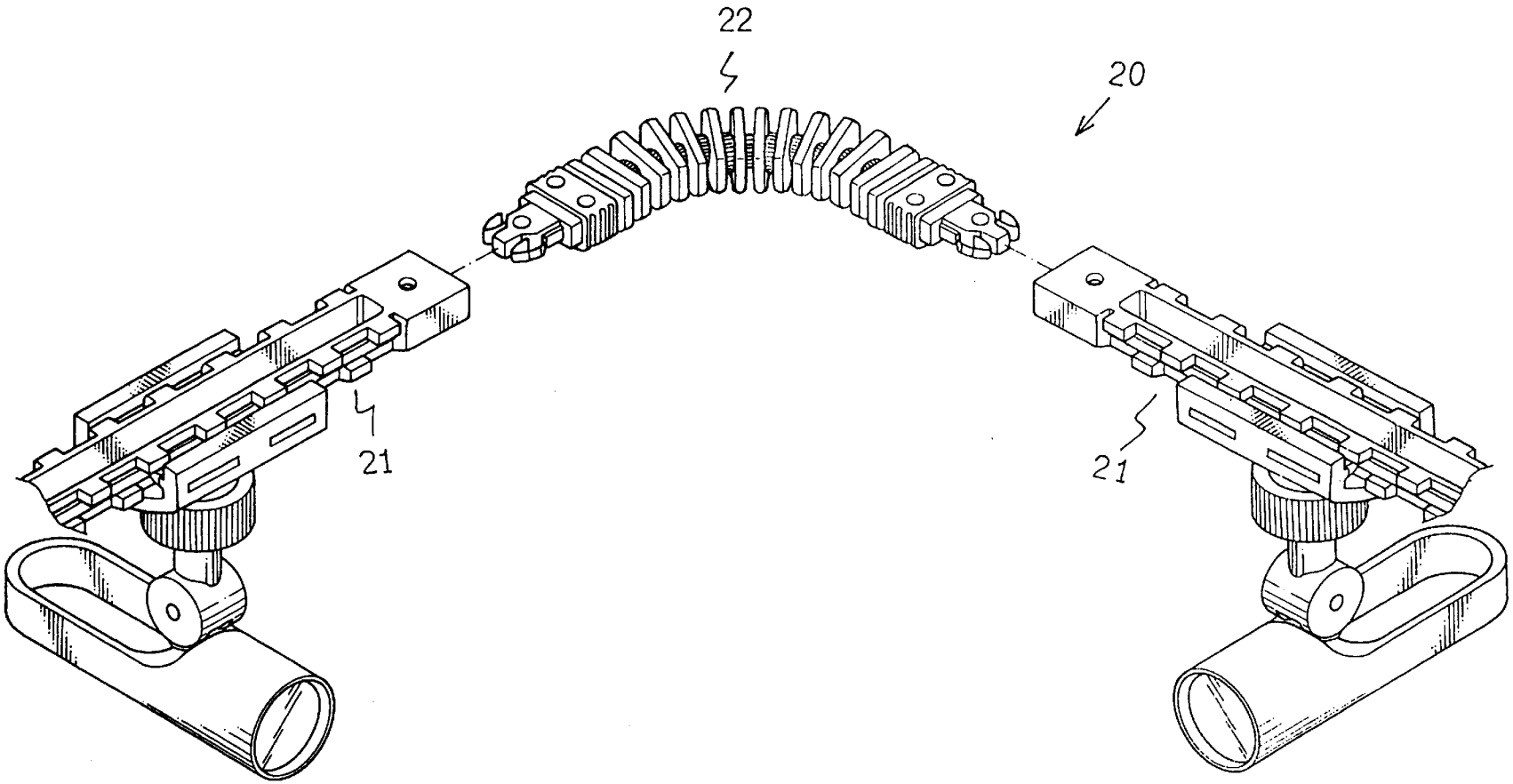
FIG. 4 PRIOR ART
FIG. 4 is an exploded view of a third conventional lamp suspension track according to the prior art.
Figure 5:
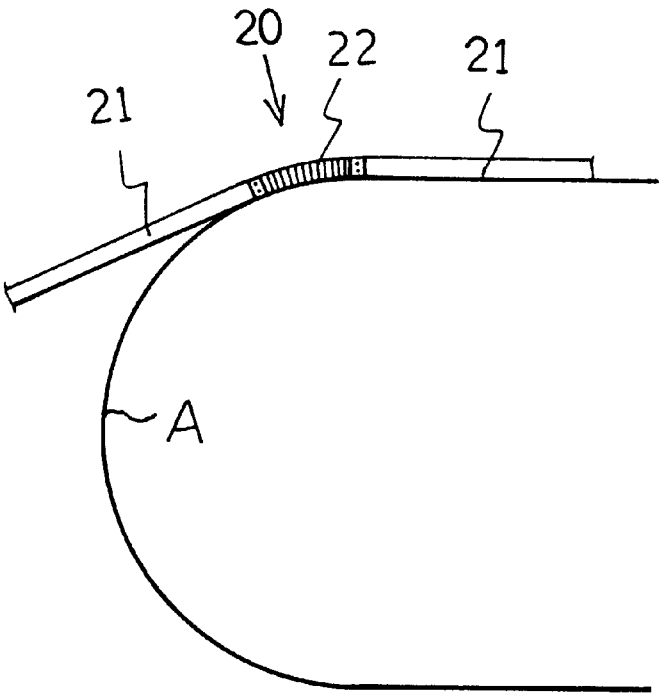
FIG. 5 PRIOR ART
FIG. 5 is a top operational view of the third conventional lamp suspension track as shown in FIG. 4.
Figure 6:
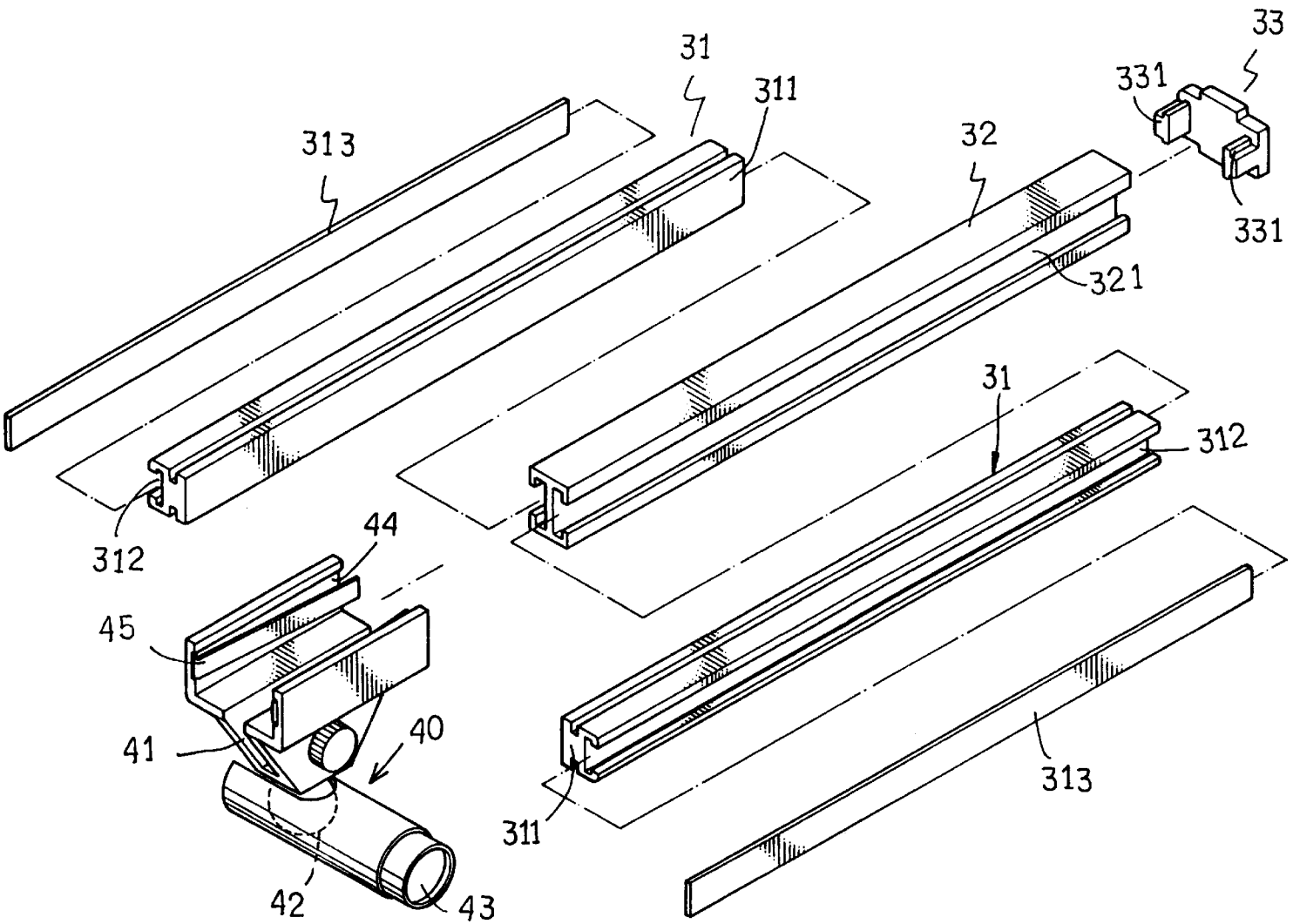
FIG. 6 is an exploded view of a lamp suspension track assembly according to the present invention.
Figure 7:
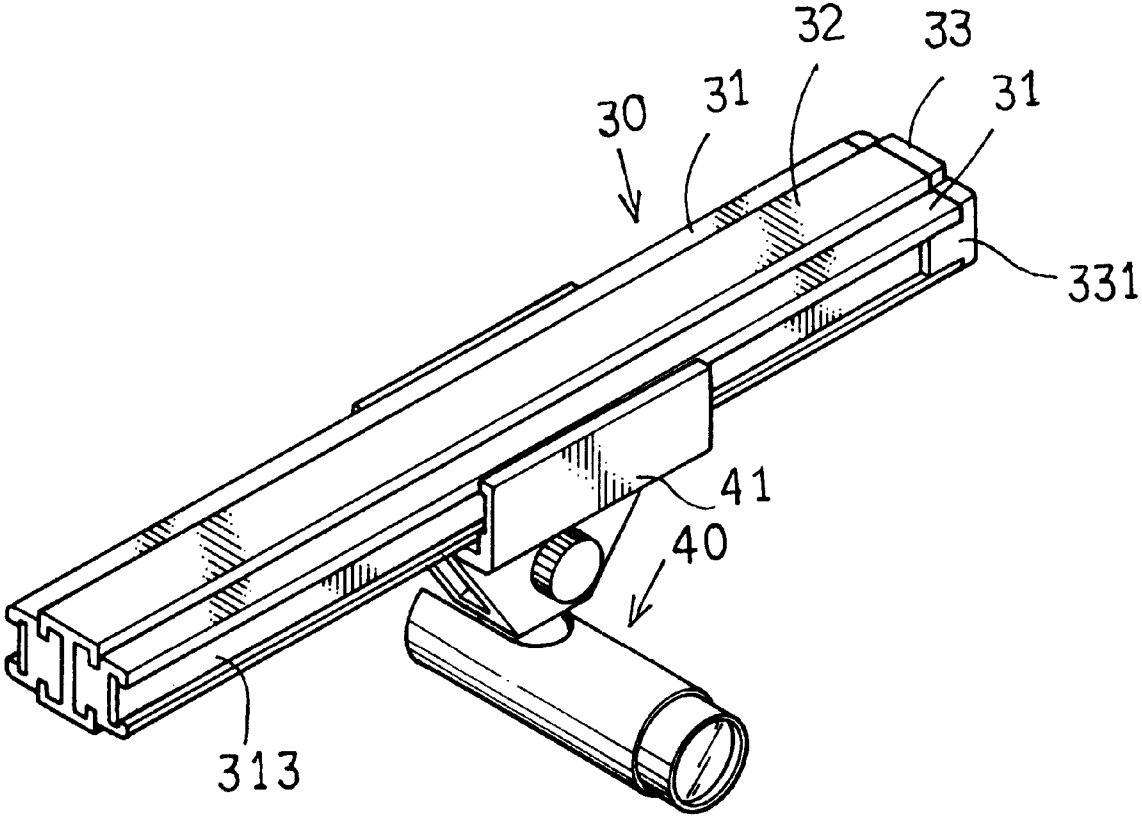
FIG. 7 is a perspective assembly view of the lamp suspension track assembly as shown in FIG. 6.
Figure 8:
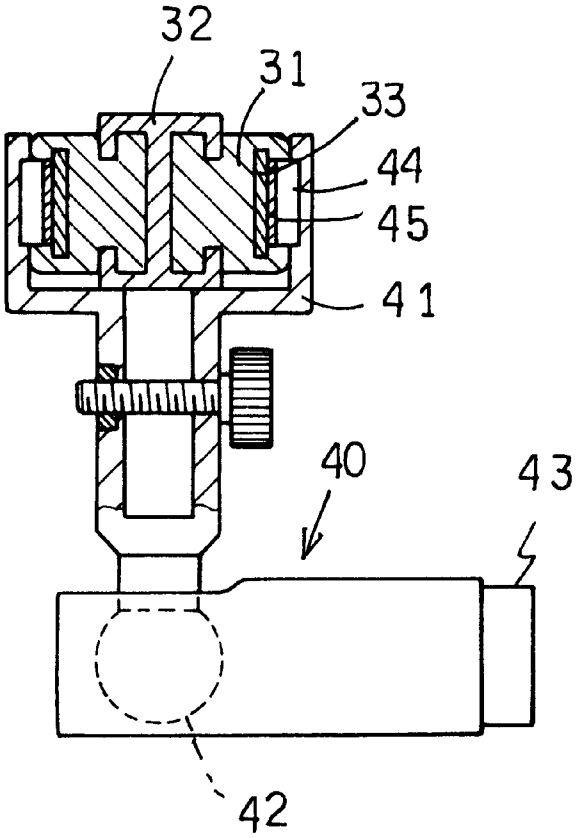
FIG. 8 is a side cross-sectional view of the lamp suspension track assembly as shown in FIG. 7.

With reference to FIGS. 6–8, a lamp suspension track assembly 30 according to the present invention can be used to hang a lamp 40 and comprises an elongated positioning guide track 32 having two opposite sides each defining a guide groove 321 therein, two elongated flexible guide tracks 31 each having a first side formed with a guide rail 311 received in the guide groove 321 of the positioning guide track 32, and a second side defining a receiving channel 312 therein, two conducting strips 313 each received in the receiving channel 312, and a positioning cap 33 attached to one end of the positioning guide track 32 and secured to one end of each of the two flexible guide tracks 31. Each of the flexible guide tracks 31 is preferably made of aluminum or aluminum alloy with great extensibility.

The guide groove 321 of the positioning guide track 32 is substantially T-shaped, and the guide rail 311 of the flexible guide track 31 is substantially T-shaped to mate with the guide groove 321.

The positioning cap 33 includes two inserts 331 each inserted into the receiving channel 312 of the respective flexible guide track 31. The guide channel 312 of the flexible guide track 31 is substantially T-shaped, and each of the two inserts 331 is substantially T-shaped to mate with the receiving channel 312.

The lamp 40 includes a substantially U-shaped clamping base 41 attached to the lamp suspension track assembly 30 and having two side walls each defining a receiving groove 44 therein, two contact conducting strips 45 each received in the receiving groove 44 and each contacting a respective conducting strip 313, a rotary connector 42 attached to the clamping 41, and attached to a bulb 43.

The lamp suspension track assembly 30 is connected to a power supply (not shown) whereby the current from the power supply is supplied into the lamp 40 by means of each of the conducting strips 313 contacting with the respective contact conducting strip 45 so as to light the bulb 43.

Figure 9:
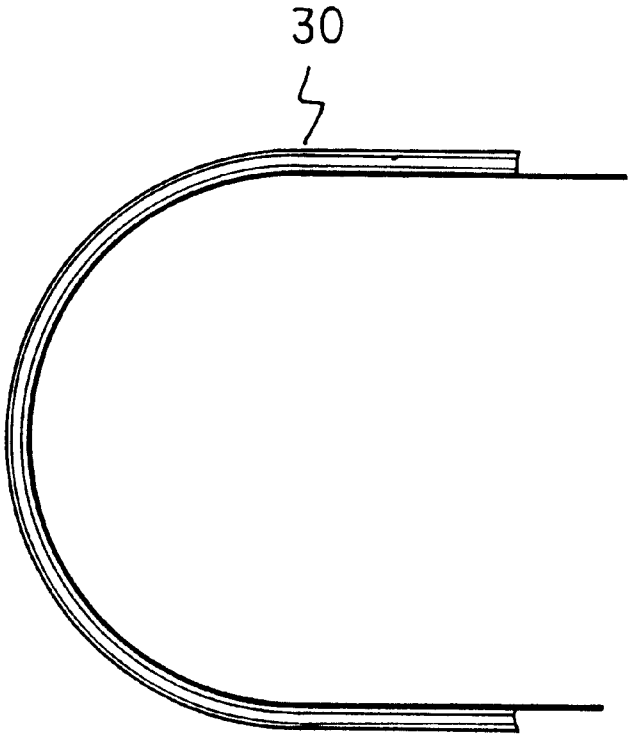
FIGS. 9 and 10 are top operational views of the lamp suspension track assembly as shown in FIG. 7.
Figure 10:
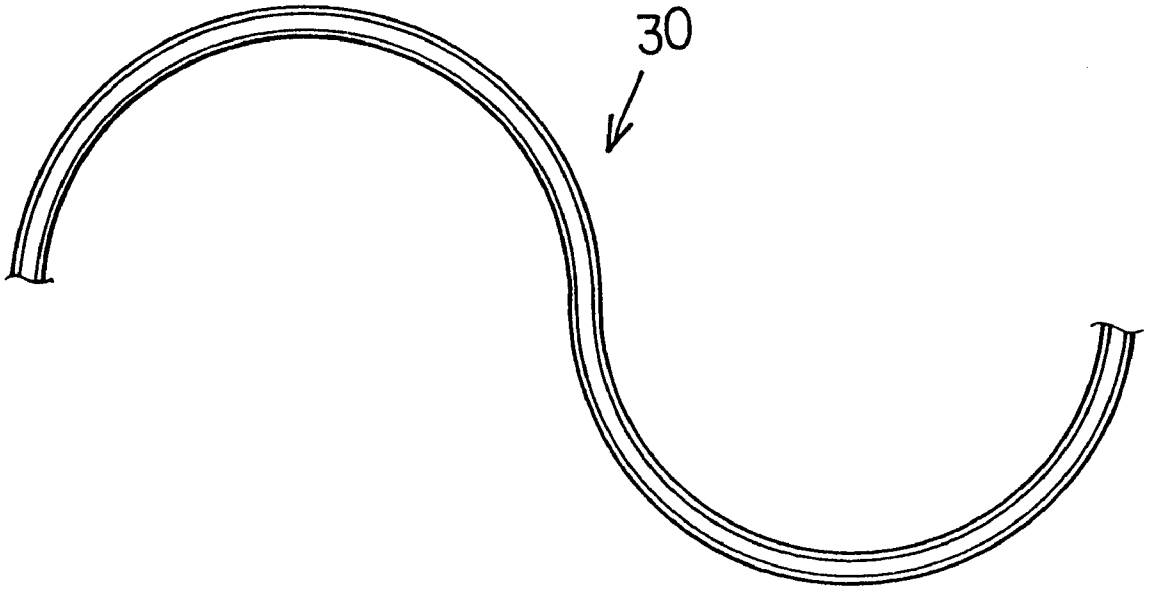

By such an arrangement, the lamp suspension track assembly 30 can be bent around a proper angle due to the flexibility of the flexible guide tracks 31 so as to form a configuration as shown in FIGS. 9 and 10, thereby increasing the versatility of the lamp suspension track assembly 30. In addition, the positioning guide track 32 located between the two flexible guide tracks 31 can be used to strengthen the lamp suspension track assembly 30, thereby maintaining the configuration of the lamp suspension track assembly 30 after being bent.

Figure 11:
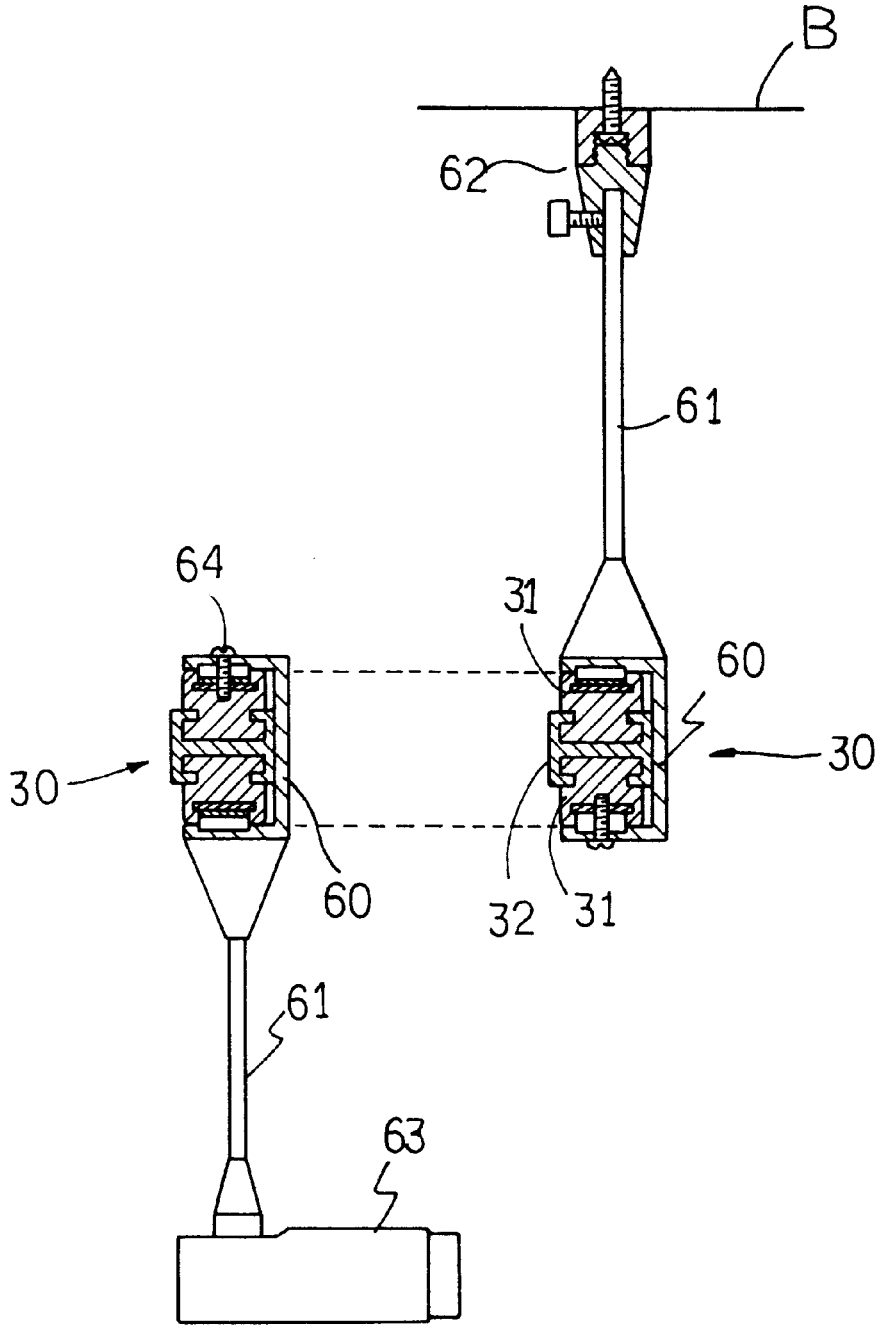
FIG. 11 is a side cross-sectional assembly view of the lamp suspension track assembly as shown in FIG. 7.

With reference to FIG. 11, a clip base 60 is attached to the lamp suspension track assembly 30 by means of a locking screw 64 to clamp the positioning guide track 32 and the flexible guide tracks 31 therein, and a suspension rod 61 is attached to the clip base 60. When the suspension rod 61 is oriented upward, a positioning base 62 can be attached to the suspension rod 61 so as to attach the lamp suspension track assembly 30 to the ceiling B. When the suspension rod 61 is oriented downward, a lamp 63 is attached to the suspension rod 61 so as to hang the lamp 63 to the lamp suspension track assembly 30.

Figure 12:
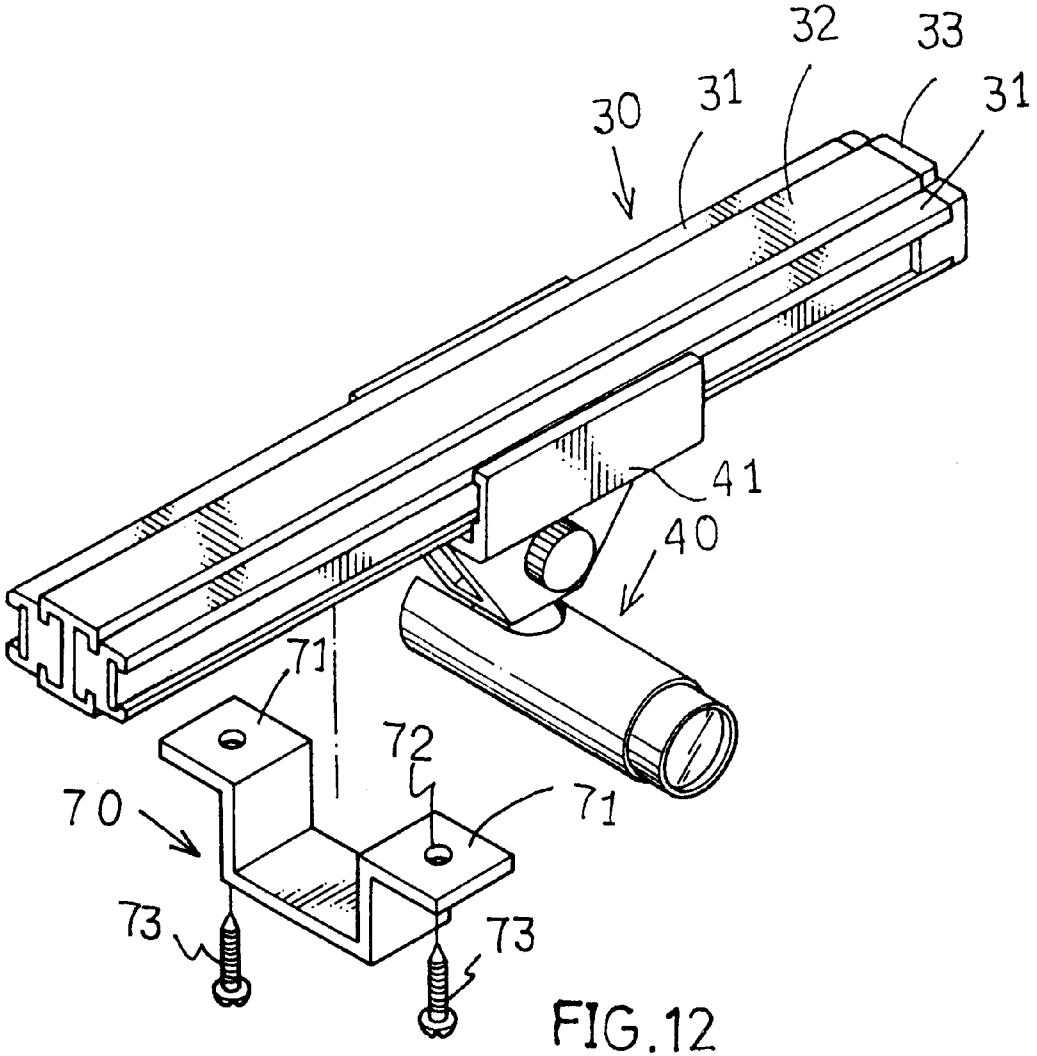
FIG. 12 is an exploded view of the lamp suspension track assembly as shown in FIG. 7.
Figure 13:
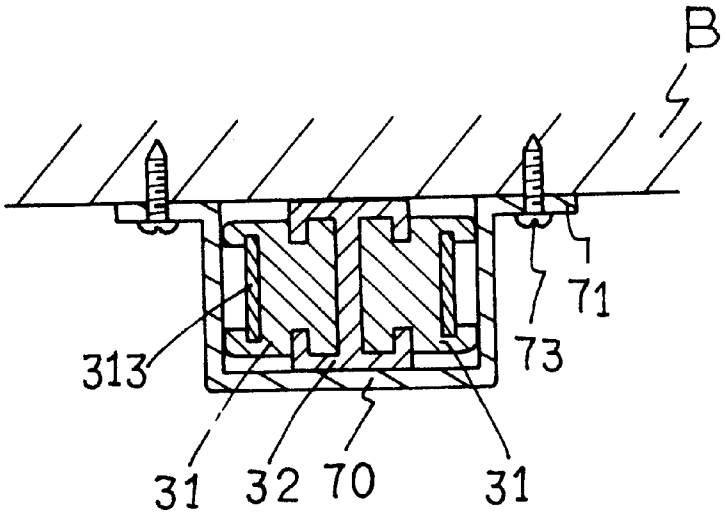
FIG. 13 is a side cross-sectional assembly view of the lamp suspension track assembly as shown in FIG. 12.

With reference to FIGS. 12 and 13, a substantially U-shaped suspension bracket 70 is used to support the positioning guide track 32 and the flexible guide tracks 31 therein. The suspension bracket 70 includes two extensions 71 each defining a through hole 72 therein, and two locking screws 73 each extending through the through hole 72 and screwed into the ceiling so as to attach the lamp suspension track assembly 30 to the ceiling B.

Figure 14:
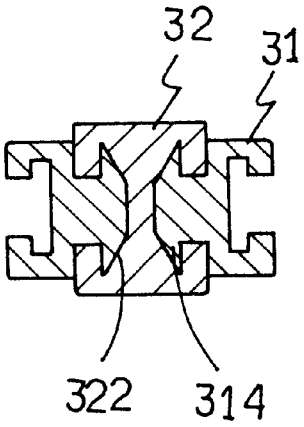
FIG. 14 is a side cross-sectional view of the lamp suspension track assembly as shown in FIG. 7 according to another embodiment of the present invention.

With reference to FIG. 14, the guide groove 321 of the positioning guide track 32 has two inclined sides 322, and the guide rail 311 of the flexible guide track 31 has two inclined sides 314 to mate with a respective inclined side 322 of the guide groove 321 of the positioning guide track 32.

Figure 15:
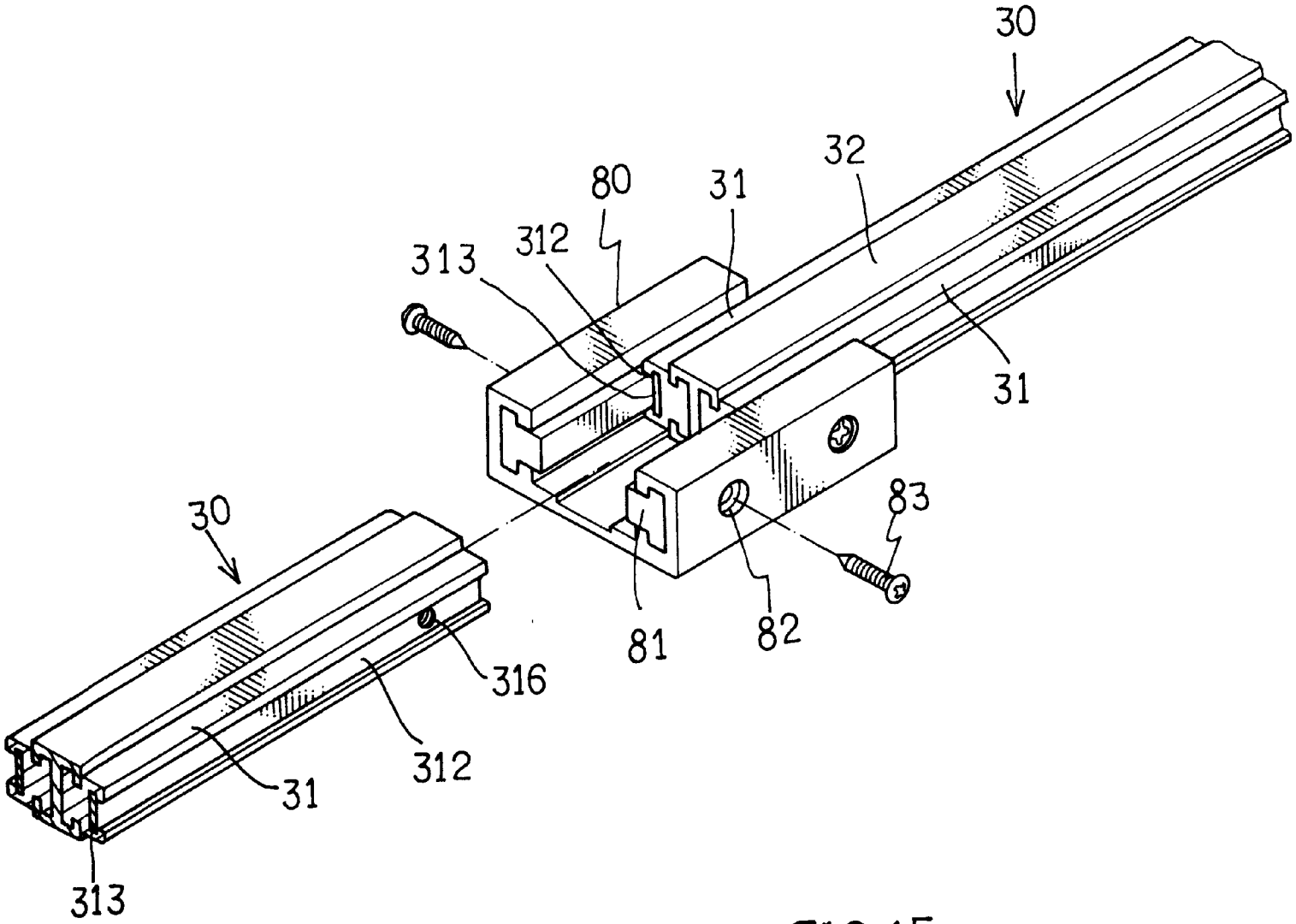
FIG. 15 is an exploded view of the lamp suspension track assembly as shown in FIG. 7.

With reference to FIG. 15, a substantially U-shaped positioning bracket 80 is used to lock the positioning guide track 32 and the flexible guide tracks 31 therein. The positioning bracket 80 includes two side walls each containing a copper bar 81 received in the receiving channel 312 of a respective flexible guide track 31 and contacting with a respective conducting strip 313. The receiving channel 312 of each of the two flexible guide tracks 31 defines a threaded bore 316 therein, each of the two side walls of the positioning bracket 80 defines a through hole 82 therein aligning with the threaded bore 316, and two locking screws 83 each extend through the through hole 82, and each screwed into the threaded bore 316, thereby attaching the positioning bracket 80 to the two lamp suspension track assemblies 30. By such an arrangement, a plurality of lamp suspension track assemblies 30 can be connected with each other by means of the positioning bracket 80.

Although the present invention has been described with a certain degree of particularity, it is to be understood that the present disclose has been made by way of example only and that many other possible modifications and variations can be made without departing from the scope and spirit of the present invention.

I claim:

1. A lamp suspension track assembly including:

an elongated positioning guide track having two opposite sides each defining a guide groove therein;

two elongated flexible guide tracks each having a first side formed with a guide rail received in the guide groove of the positioning guide track, and a second side defining a receiving channel therein;

two conducting strips each received in the receiving channel; and a positioning cap attached to one end of the positioning guide track and secured to one end of each of the two flexible guide tracks.

2. The lamp suspension track assembly as claimed in claim 1, wherein each of the flexible guide tracks is made of aluminum or aluminum alloy.

3. The lamp suspension track assembly as claimed in claim 1, wherein the guide groove of the positioning guide track is substantially T-shaped, and the guide rail of the flexible guide track is substantially T-shaped to mate with the guide groove.

4. The lamp suspension track assembly as claimed in claim 1, further comprising a substantially U-shaped suspension bracket to support the positioning guide track and the flexible guide tracks therein, the suspension bracket includes two extensions each defining a through hole therein, and two locking screws each extending through the through hole and screwed into a ceiling.

5. The lamp suspension track assembly as claimed in claim 1, wherein the guide groove of the positioning guide track has two inclined sides, and the guide rail of the flexible guide track has two inclined sides to mate with a respective inclined side of the guide groove of the positioning guide track.

6. The lamp suspension track assembly as claimed in claim 1, wherein the positioning cap includes two inserts each inserted into the receiving channel of the respective flexible guide track.

7. The lamp suspension track assembly as claimed in claim 6, wherein the guide channel of the flexible guide track is substantially T-shaped, and each of the two inserts is substantially T-shaped to mate with the receiving channel.

8. The lamp suspension track assembly as claimed in claim 1, further comprising a clip base to clamp the positioning guide track and the flexible guide tracks therein, and a suspension rod attached to the clip base.

9. The lamp suspension track assembly as claimed in claim 8, further comprising a positioning base attached to the suspension rod.

10. The lamp suspension track assembly as claimed in claim 1, further comprising a substantially U-shaped positioning bracket to lock the positioning guide track and the flexible guide tracks therein, the positioning bracket including two side walls each containing a copper bar received in the receiving channel of a respective flexible guide track.

11. The lamp suspension track assembly as claimed in claim 10, wherein the receiving channel of each of the two flexible guide tracks defines a threaded bore therein, each of the two side walls of the positioning bracket defines a through hole therein aligning with the threaded bore, and the lamp suspension track assembly further comprises two locking screws each extending through the through hole, and screwed into the threaded bore.

* * * * *